US012253267B2

(12) United States Patent
Miranda

(10) Patent No.: US 12,253,267 B2
(45) Date of Patent: Mar. 18, 2025

(54) APPLIANCE DOOR HAVING A CAMERA BRACKET LOCATOR

(71) Applicant: Haier US Appliance Solutions, Inc., Wilmington, DE (US)

(72) Inventor: Mariana Miranda, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 449 days.

(21) Appl. No.: 17/591,723

(22) Filed: Feb. 3, 2022

(65) Prior Publication Data

US 2023/0272917 A1 Aug. 31, 2023

(51) Int. Cl.
*F24C 7/08* (2006.01)
*F24C 15/00* (2006.01)
*F24C 15/04* (2006.01)

(52) U.S. Cl.
CPC ..... *F24C 7/085* (2013.01); *F24C 15/008* (2013.01); *F24C 15/04* (2013.01)

(58) Field of Classification Search
CPC ..... F24C 15/008; F24C 15/04; F24C 7/085
See application file for complete search history.

(56) References Cited

U.S. PATENT DOCUMENTS 4,689,726 A * 8/1987 Kretzschmar ..... F21S 4/20 362/127
5,034,861 A * 7/1991 Sklenak ..... A47F 3/001 312/236
5,699,676 A * 12/1997 Trulaske, Sr. ..... F25D 27/00 49/501
6,361,181 B1 * 3/2002 Bales ..... F24C 15/04 362/253
10,440,245 B1 * 10/2019 Johnson ..... H04N 23/57
2016/0061514 A1 * 3/2016 Seo ..... F21V 33/0044 312/405
2017/0000292 A1 1/2017 Park et al.
2019/0221144 A1 * 7/2019 Artwohl ..... G09G 3/2096
2020/0025389 A1 * 1/2020 Erbe ..... F24C 15/04
2020/0267996 A1 8/2020 Wersborg et al.
(Continued)

FOREIGN PATENT DOCUMENTS

CN 109330398 2/2019
CN 109330398 A * 2/2019 ..... A47J 27/04
CN 209415524 9/2019
(Continued)

*Primary Examiner* — Jorge A Pereiro
*Assistant Examiner* — Logan P Jones
(74) *Attorney, Agent, or Firm* — Dority & Manning, P.A.

(57) ABSTRACT

An oven door may include a front panel, a pair of trim panels attached to the front panel, a bracket assembly, a plurality of light sources mounted to the bracket assembly, and a camera mounted to the bracket assembly. The pair of trim panels may include a first trim panel and a second trim panel laterally spaced apart by a door cavity defined therebetween. The first trim panel and the second trim panel may each include an interior surface directed toward the door cavity. The first trim panel may define a first bracket slot. The bracket assembly may extend through the door cavity between the first trim panel and the second trim panel. The bracket assembly may include a back bracket and a first support flange received within the first bracket slot.

19 Claims, 9 Drawing Sheets

(56) References Cited

U.S. PATENT DOCUMENTS

2021/0003289 A1* 1/2021 Iwamoto ..... F24C 15/02

FOREIGN PATENT DOCUMENTS

| | | | | | |
|---|---|---|---|---|---|
| CN | 111608546 | | | 9/2020 | |
| DE | 102017203305 | | | 9/2018 | |
| FR | 1452726 | A | * | 4/1966 | |
| WO | WO-2015155020 | A1 | * | 10/2015 | ..... F24C 15/008 |
| WO | WO2019218685 | | | 11/2019 | |
| WO | WO-2019218685 | A1 | * | 11/2019 | |

* cited by examiner

APPLIANCE DOOR HAVING A CAMERA BRACKET LOCATOR

FIELD OF THE INVENTION

The present subject matter relates generally to household appliances and more particularly to appliance doors.

BACKGROUND OF THE INVENTION

Oven appliances are useful for baking within an oven cavity located inside the oven appliance. Oven appliances may be set to a temperature to control heat present in the oven cavity. An oven door generally allows for access into and out of the oven cavity. This allows for precise baking, roasting, and cooking of articles such as food therein. Some oven appliances allow for visual monitoring of articles within the oven cavity during the cooking period (e.g., when articles are in the oven cavity and the oven is baking said articles). Visual monitoring of articles in the oven cavity may include a glass panel or panels as a part of the door to allow a user to see the articles inside the oven cavity without having to open an oven door. Furthermore, a light, such as a halogen bulb, is sometimes placed within the oven cavity, and may be controlled by a switch on a control panel on the oven appliance, external to the oven cavity, allowing for illumination of articles within the oven cavity.

Further improvements on visual monitoring of articles within oven cavities may include a camera to view images of the oven cavity and the contents therein. Cameras placed in an oven cavity can allow a user to monitor articles within the oven cavity without having to be physically present at the oven cavity. However, problems often exist with lighting features (e.g., the aforementioned light present in the oven cavity), which can distort the coloring of articles captured by the camera. Distorted images may be a problem because a user may not have an accurate representation of the color of the articles, which may make determining doneness of the articles inside the oven cavity difficult. Additionally, lighting can add an undesired glare or mirror effect to images captured by the camera, further distorting images or colors of the articles in the oven cavity.

In some cases, cameras provided with an oven may be unable to capture all of the oven cavity, leaving some portions of the oven cavity out of images produced by the camera. The camera's images may therefore not show all articles placed inside the oven cavity, which provides only a partial depiction to the user as to what is going on inside the oven cavity.

Accordingly an oven appliance or door with one or more features to illuminate the oven cavity (e.g., while producing a more color accurate image) would be useful. Furthermore, an oven appliance or door with one or more features to more accurately capture articles inside the oven cavity may be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven door is provided. The oven door may have a transverse, a vertical, and a lateral direction. The oven door may include a front panel, a pair of trim panels attached to the front panel, a bracket assembly, a plurality of light sources mounted to the bracket assembly, and a camera mounted to the bracket assembly. The pair of trim panels may include a first trim panel and a second trim panel laterally spaced apart by a door cavity defined therebetween. The first trim panel and the second trim panel may each include an interior surface directed toward the door cavity. The first trim panel may define a first bracket slot. The bracket assembly may extend through the door cavity between the first trim panel and the second trim panel. The bracket assembly may include a back bracket and a first support flange received within the first bracket slot.

In another exemplary aspect of the present disclosure, an oven door is provided. The oven door may have a transverse, a vertical and a lateral direction. The oven door may include a front panel, a rear panel, a pair of trim panels attached to the front panel, a bracket assembly, a plurality of light sources mounted to the bracket assembly, and a camera mounted to the bracket assembly. The pair of trim panels may include a first trim panel and a second trim panel laterally spaced apart by a door cavity defined therebetween. The first trim panel may include a first interior surface. The second trim panel may include a second interior surface. The first interior surface and the second interior surface may be directed toward the door cavity. The first trim panel may define a first bracket slot. The bracket assembly may extend through the door cavity between the first trim panel and the second trim panel. The bracket assembly may include a back bracket and a first support flange received within the first bracket slot. The back bracket may include a main body and a first wing. The first wing may extend transversely toward the rear panel. The main body may extend vertically and laterally across the oven door between the pair of trim panels. The first support flange may attach to the first wing. The first support flange may extend orthogonally from the first wing in the transverse and the lateral directions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same of similar reference numerals in the figures denotes the same or similar features unless the context indicates otherwise.

DETAILED DESCRIPTION

Figure 1:
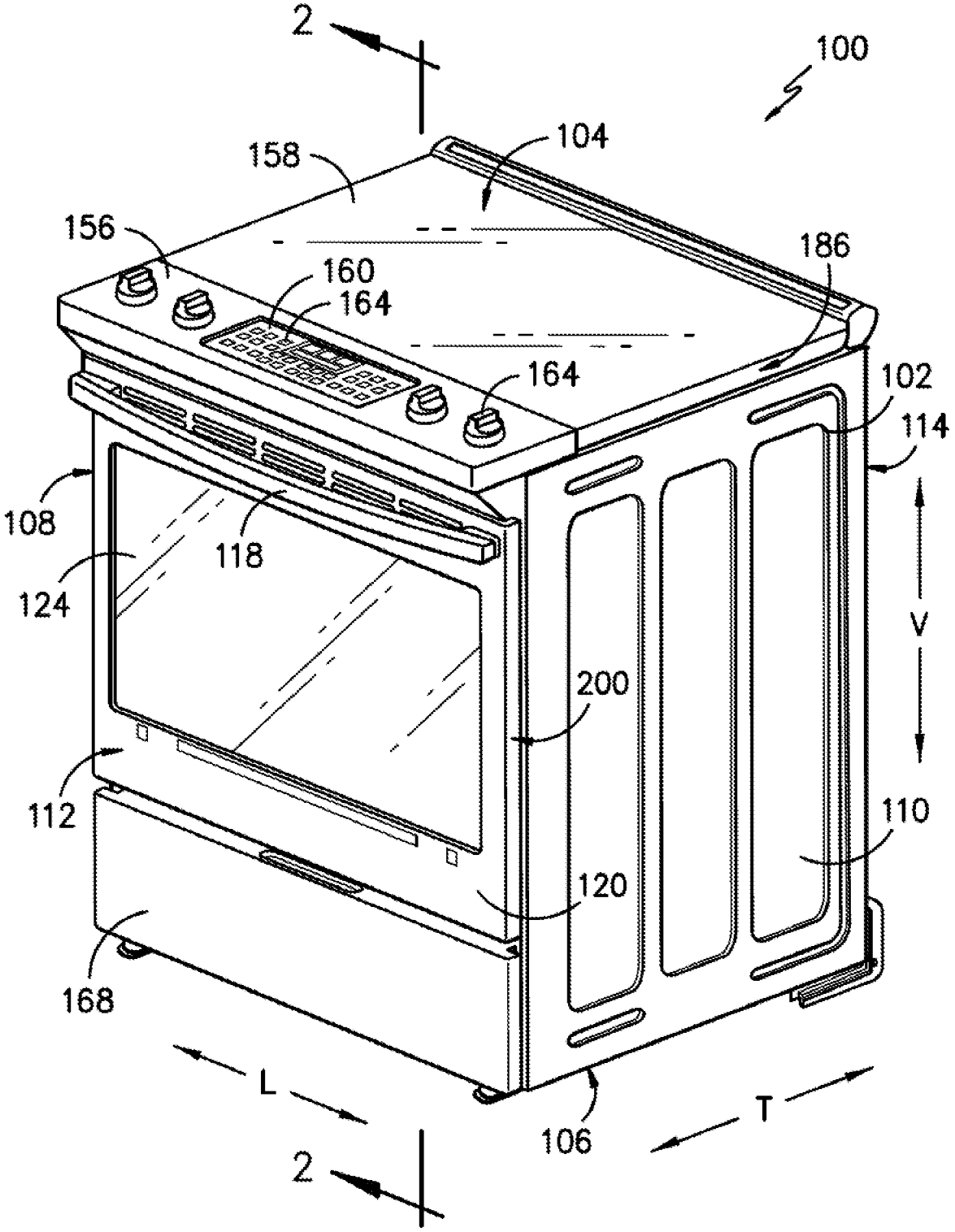
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Terms such as "inner" and "outer" refer to relative directions with respect to the interior and exterior of the oven appliance, and in particular the chamber (s) defined therein. For example, "inner" or "inward" refers to the direction towards the interior of the oven appliance. Terms such as "left," "right," "front," "back," "top," or "bottom" are used with reference to the perspective of a user accessing the appliance (e.g., when the door is in the closed position). For example, a user stands in front of the appliance to open a door and reaches into the internal chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise, or counterclockwise, with the vertical direction V).

Embodiments described herein may include a bracket assembly for a door, such as an oven appliance door. The backet assembly may have a camera centrally placed thereon and plurality of light sources may extend laterally along the backet assembly from either lateral side of the camera. The backet assembly may be attached to the door at a pair of trim panels, the trim panels extending on lateral ends and forming a door cavity therebetween. The camera may be angled toward an internal chamber of the appliance and may notably be able to achieve a more true-to-life color to the images produced by the camera (as compared to existing systems). In some embodiments, glare, such as when the camera is behind a rear glass panel of the door, may also be advantageously reduced or prevented.

As will be understood by those skilled in the art, oven appliance 100 is provided by way of example only, and the present subject matter may be used in any suitable household appliance. Thus, the present subject matter may be used with other oven appliances having different configurations, such as wall ovens, electric ovens, gas ovens, etc. The present subject matter may further be used with other household appliances such as microwave ovens, washing machine appliances, dryer appliances, dishwashing appliances, refrigerator appliances, etc. Oven appliance 100 will be described below, with the understanding that other embodiments may include or be provided as another suitable household appliance (e.g., defining an internal chamber).

Figure 2:
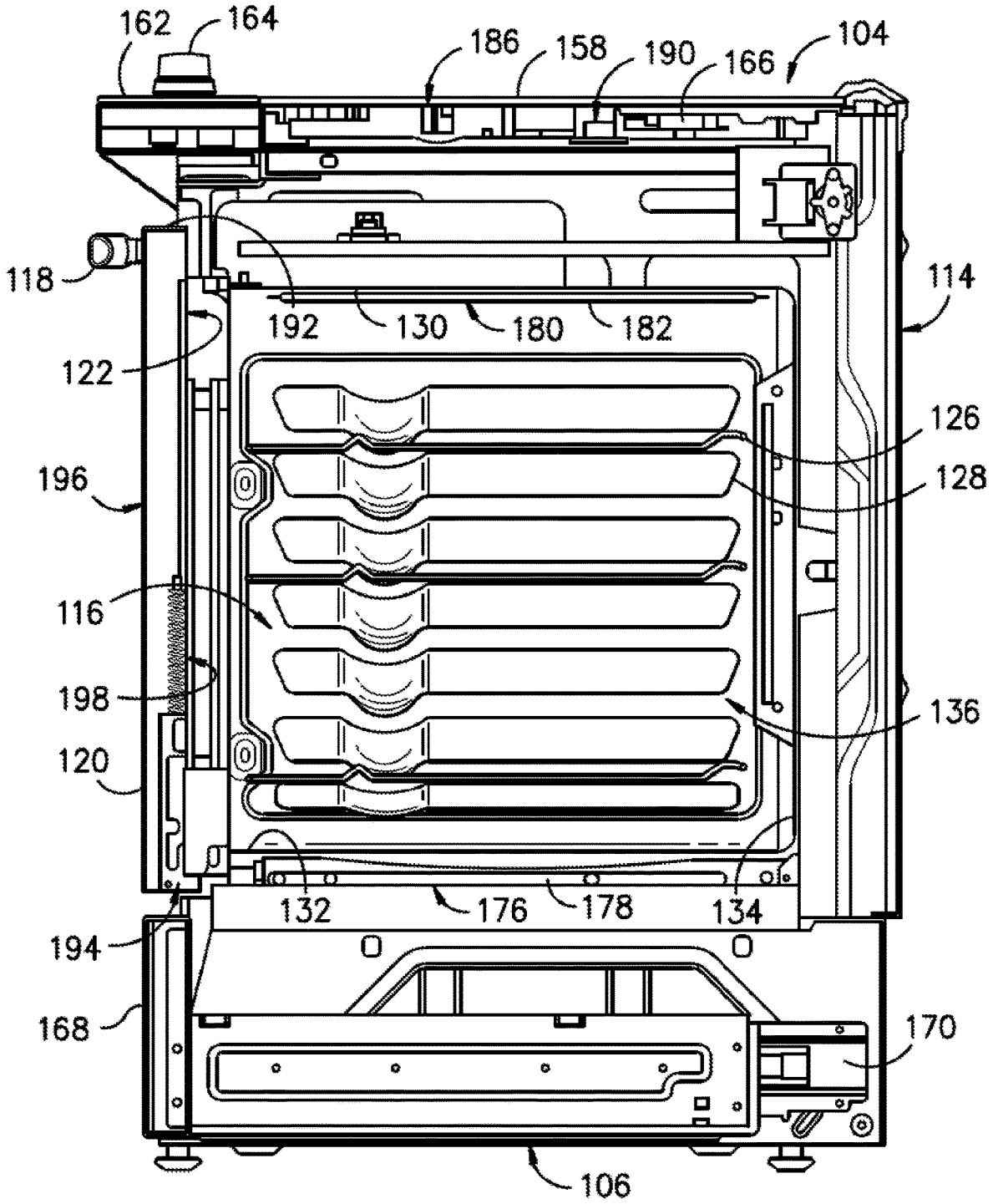
FIG. 2 provides a side, cross sectional view of the exemplary oven appliance of FIG. 1.

Referring now to the figures, an exemplary appliance will be described in accordance with exemplary aspects of the present subject matter. Specifically, FIG. 1 provides a perspective view of an exemplary oven appliance 100 and FIG. 2 provides a side cross-sectional view of oven appliance 100. As illustrated, oven appliance 100 generally defines a vertical direction V, a lateral direction L, and a transverse direction T, each of which is mutually perpendicular, such that an orthogonal coordinate system is generally defined.

According to exemplary embodiments, oven appliance 100 includes a cabinet 102 that is generally configured for containing or supporting various components of oven appliance 100 and which may also define one or more internal chambers or compartments of oven appliance 100. In this regard, as used herein, the terms "cabinet," "housing," and the like are generally intended to refer to an outer frame or support structure for oven appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of oven appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along vertical direction V, between a first side 108 (e.g., the left side when viewed from the front as in FIG. 1) and a second side 110 (e.g., the right side when viewed from the front as in FIG. 1) along lateral direction L, and between a front 112 and a rear 114 along transverse direction T.

Oven appliance 100 includes an internal chamber 116 disposed or defined within cabinet 102. Internal chamber 116 may be insulated. In some embodiments, internal chamber 116 is configured for the receipt of one or more items to be cooked, including food items. Cabinet 102 defines internal chamber 116 between a top wall 130 and a bottom wall 132. Oven appliance 100 includes a door 120 rotatably mounted to cabinet 102 (e.g., with a hinge). A handle 118 is mounted to door 120 and assists a user with opening and closing door 120 in order to access internal chamber 116. For example, a user can pull on handle 118 to open or close door 120 and access internal chamber 116 through a resultant opening. As would be understood, one or more internal heating elements (e.g., baking heating elements 178 or broiling heating elements 182) may be provided within internal chamber 116 to cook or otherwise heat items therein.

Oven appliance 100 can include a seal 122 (e.g., gasket) between door 120 and cabinet 102 that assists with maintaining heat and cooking fumes within internal chamber 116 when door 120 is closed as shown. Door 120 may include a window 124, constructed for example from multiple parallel glass panes (e.g., glass panels 238, 240) to provide for viewing contents of internal chamber 116 when door 120 is closed and assist with insulating internal chamber 116. A baking rack 126 may be positioned in internal chamber 116 for the receipt of food items or utensils containing food items. Baking rack 126 may be slidably received onto embossed ribs 128 or sliding rails such that baking rack 126 may be conveniently moved into and out of internal chamber 116 when door 120 is open.

Generally, various sidewalls define internal chamber 116. For example, internal chamber 116 includes a top wall 130 and a bottom wall 132 that are spaced apart along vertical direction V. Left and right sidewalls extend between top wall 130 and bottom wall 132, and are spaced apart along lateral direction L. A rear wall 134 may additionally extend between top wall 130 and bottom wall 132 as well as between the left and right sidewalls, and is spaced apart from door 120 along transverse direction T. In this manner, when door 120 is in the closed position, a cavity 136 (also referred to as "cooking cavity 136" herein) is defined by door 120 and top wall 130, bottom wall 132, sidewalls, rear wall 134 of internal chamber 116.

In some examples, top 104 includes a front panel 156 or cooktop panel 158. Front panel 156 may be located transversely forward of cooktop panel 158. Front panel 156 may house a controller 162 or controls 164, as described in more detail below. Additionally or alternatively, cooktop panel 158 may be proximal to a plurality of heating assemblies 166, as described in more detail below.

A lower heating assembly (e.g., bake heating assembly 176) may be positioned in oven appliance 100, and may include one or more heating elements (e.g., bake heating elements 178). Bake heating elements 178 may be disposed within internal chamber 116, such as adjacent bottom wall 132. In exemplary embodiments as illustrated, bake heating elements 178 are electric heating elements, as is generally understood. Alternatively, bake heating elements 178 may be gas burners or other suitable heating elements having other suitable heating sources. Bake heating elements 178 may generally be used to heat internal chamber 116 for both cooking and cleaning of oven appliance 100.

Additionally or alternatively, an upper heating assembly (e.g., broil heating assembly 180) may be positioned in oven appliance 100, and may include one or more upper heating elements (e.g., broil heating elements 182). Broil heating elements 182 may be disposed within internal chamber 116, such as adjacent top wall 130. In exemplary embodiments as illustrated, broil heating elements 182 are electric heating elements, as is generally understood. Alternatively, broil heating elements 182 may be gas burners or other suitable heating elements having other suitable heating sources. Broil heating elements 182 may additionally be used to heat internal chamber 116 for both cooking and cleaning of oven appliance 100.

In some embodiments, oven appliance 100 includes a cooktop 186 positioned at cooktop panel 158 of oven appliance 100. In such embodiments, cooktop panel 158 may be a generally planar member having an upward surface that is perpendicular to vertical direction V. In particular, cooktop panel 158 may be formed from glass, glass ceramic, metal, or another suitable material. A plurality of heating assemblies (e.g., cooktop heating assemblies 166) may be mounted to or otherwise positioned on cooktop panel 158. In some embodiments, cooktop heating assemblies 166 are positioned above internal chamber 116 of cabinet 102 (i.e., higher relative to vertical direction V). Optionally, cooktop heating assemblies 166 may extend between internal chamber 116 and cooktop panel 158, within an open region 190 that is defined between cooktop panel 158 and internal chamber 116. Cooking utensils, such as pots, pans, griddles, etc., may be placed on cooktop panel 158 and heated with heating assemblies 166 during operation of cooktop 186. In FIGS. 1 and 2, cooktop heating assemblies 166 are shown as radiant heating elements mounted below cooktop panel 158. However, in alternative example embodiments, cooktop heating assemblies 166 may be any suitable heating assembly, such as gas burner elements, resistive heating elements, induction heating elements, or other suitable heating elements.

Door 120 is mounted on cabinet 102 below cooktop panel 158 to selectively allow access to internal chamber 116. As may be seen in FIG. 2, door 120 extends between a top lip 192 and a bottom lip 194 (e.g., along vertical direction V when door 120 is in the closed position). Door 120 may further extend between a front surface 196 and a rear surface 198 (e.g., along transverse direction T when door 120 is in the closed position). Handle 118 may be provided on door 120 proximal to top lip 192.

In some embodiments, oven appliance 100 includes a drawer 168 movably mounted to cabinet 102. For instance, drawer 168 may be slidably mounted to cabinet 102 to selectively move forward/rearward along transverse direction T. One or more slidable rails, bearings, or assemblies 170 may be installed or mounted between drawer 168 and cabinet 102 to facilitate movement of drawer 168 relative to cabinet 102, as would be understood. As shown, drawer 168 may be disposed generally below internal chamber 116. In particular, drawer 168 may be disposed below door 120.

Oven appliance 100 is further equipped with a controller 162 to regulate operation of oven appliance 100. For example, controller 162 may regulate the operation of oven appliance 100, including activation of heating elements (e.g., baking heating elements 178, broiling heating elements 180) as well as heating assemblies 166, 176, 180 generally. Controller 162 may be in operable communication (e.g., via a suitable electronic wired connection) with the heating elements and other components of oven appliance 100, as discussed herein. In general, controller 162 may be operable to configure oven appliance 100 (and various components thereof) for cooking. Such configuration may be based on a plurality of cooking factors of a selected operating cycles, sensor feedback, etc.

By way of example, controller 162 may include one or more memory devices (e.g., non-transitive media) and one or more microprocessors, such as general or special purpose microprocessors operable to execute programming instructions or micro-control code associated with an operating cycle. The memory may represent random access memory such as DRAM or read only memory such as ROM or FLASH. In exemplary embodiments, the processor executes programming instructions stored in memory. The memory may be a separate component from the processor or may be included onboard within the processor.

Controller 162 may be positioned in a variety of locations throughout oven appliance 100. For instance, controller 162 may be located within a user interface panel (also referred to as control panel 160) of oven appliance 100, as shown in FIG. 2. In some such embodiments, input/output ("I/O") signals may be routed between the control system and various operational components of oven appliance 100 along wiring harnesses that may be routed through cabinet 102. In some embodiments, controller 162 is in operable communication (e.g., electronic or wireless communication) with user interface panel and controls 164, through which a user may select various operational features and modes and monitor progress of oven appliance 100. In optional embodiments, user interface panel may represent a general purpose I/O ("GPIO") device or functional block. In certain embodiments, user interface panel includes input components or controls 164, such as one or more of a variety of electrical, mechanical, or electro-mechanical input devices including rotary dials, push buttons, and touch pads. Additionally or alternatively, user interface panel may include a display component, such as a digital or analog display device designed to provide operational feedback to a user. User interface panel may be in operable communication with controller 162 via one or more signal lines or shared communication busses.

Furthermore, the user interface panel (e.g., control panel 160) is located within convenient reach of a user of appliance. User interface panel includes various input components, such as one or more of a variety of touch-type controls 164, electrical, mechanical, or electro-mechanical input devices including knobs, rotary dials, push buttons, and touch pads. The user interface panel may include a display component, such as a digital or analog display device, designed to provide operational feedback to a user.

Various appliance features of appliance may be activated/deactivated by a user manipulating the input components on user interface panel. Thus, for example, when appliance is a cooktop 186 or oven appliance 100, a user may manipulate knobs or buttons on user interface panel to activate and deactivate heating elements of appliance 100. As another example, a user of appliance may set a timer on user interface panel.

Turning now to FIGS. 3 through 9, various views are provided of door 120 (e.g., in isolation or apart from cabinet 102-FIG. 1). As shown, door 120 may generally define a mutually orthogonal lateral direction L, vertical direction V, and transverse direction T. The lateral direction L, vertical direction V, and transverse direction T described with respect to FIGS. 3 through 9 may generally correspond to the lateral direction L, vertical direction V, and transverse direction T described with respect FIGS. 1 and 2 (e.g., when door 120 is in the closed position). Nonetheless, it is understood that the directions described with respect to the door 120 are independent from the cabinet 102 and other stationary elements of appliance 100.

Figure 3:
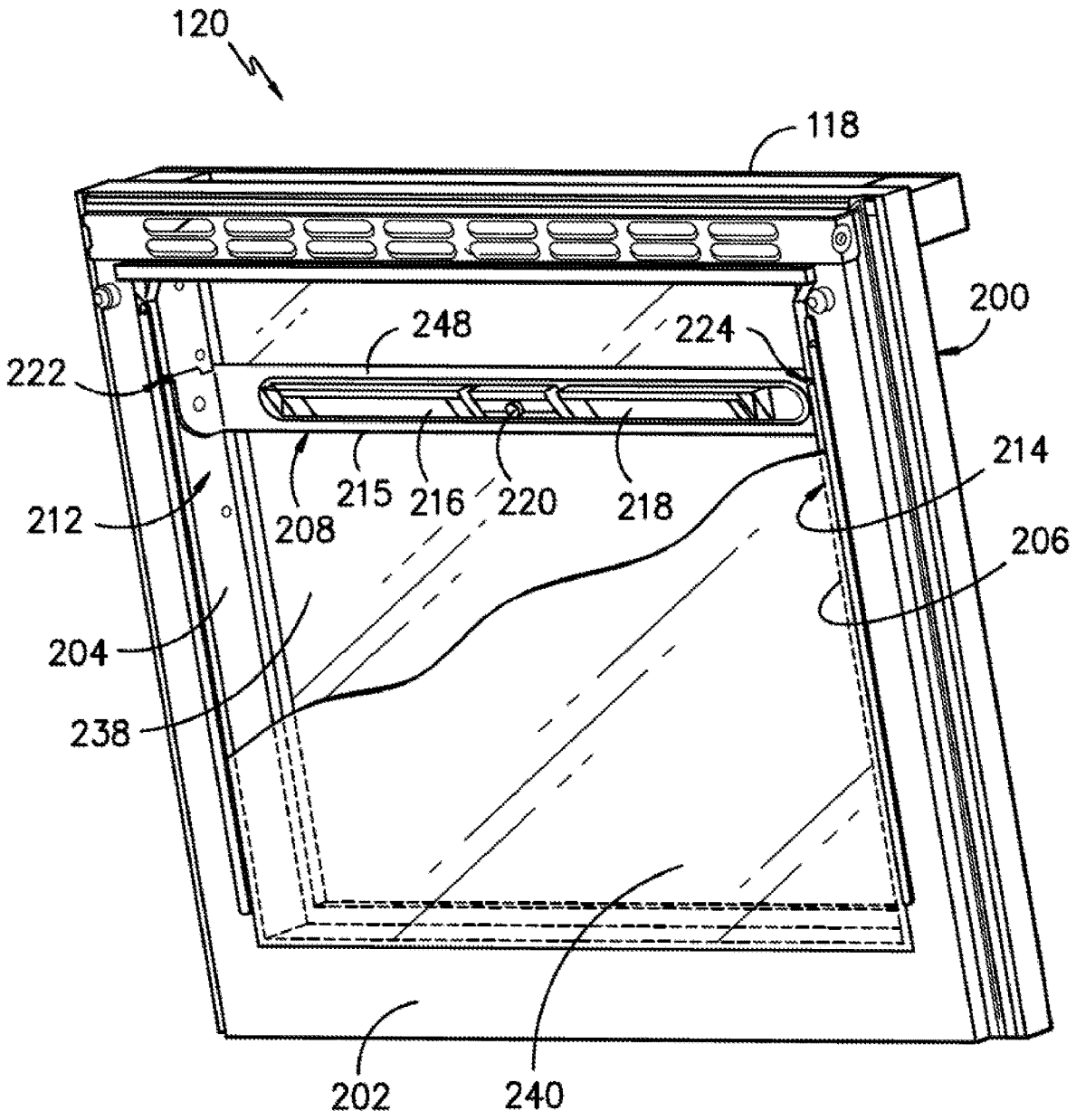
FIG. 3 provides a rear perspective view of an oven door according to exemplary embodiments of the present disclosure.
Figure 4:
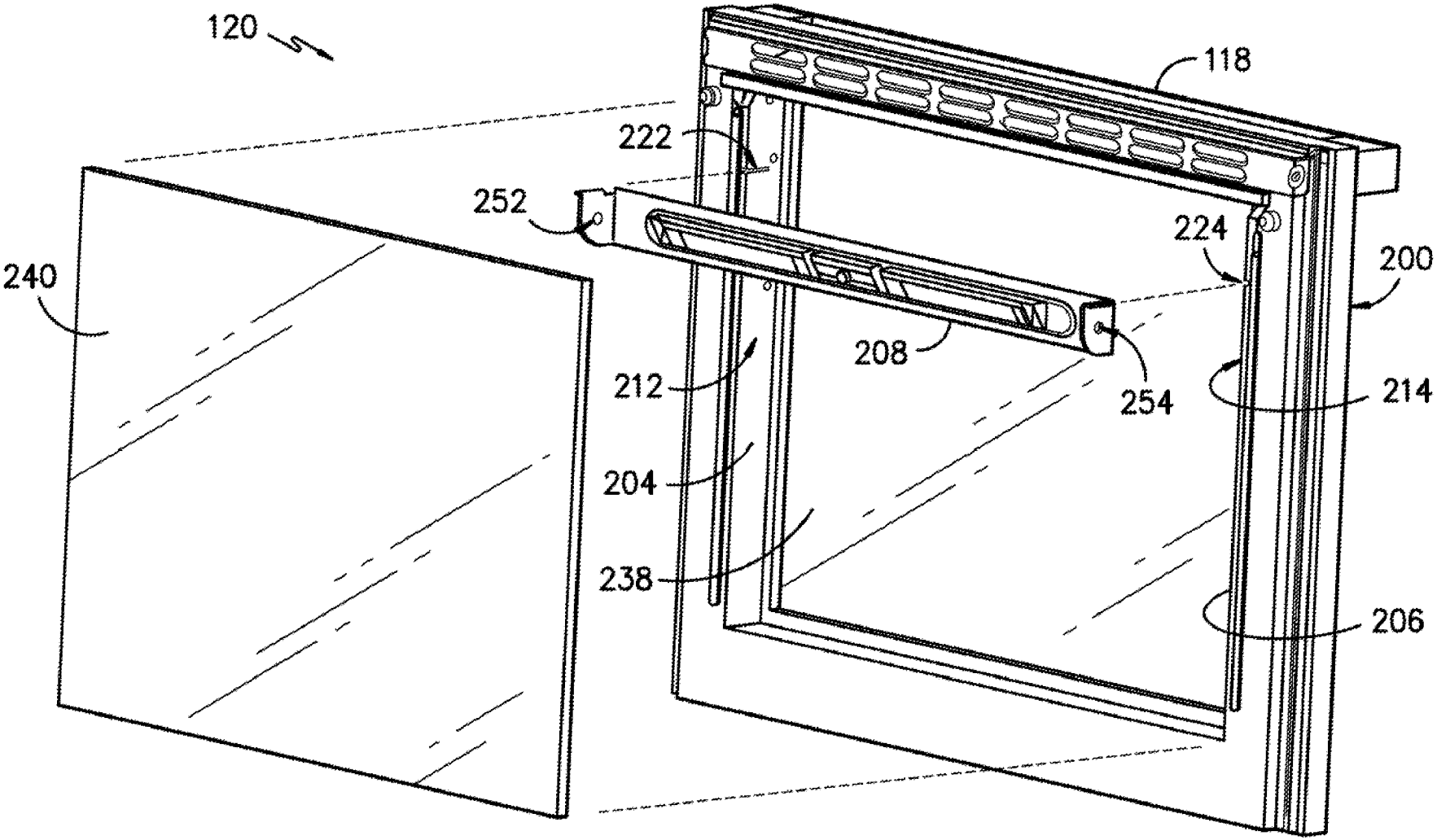
FIG. 4 provides an exploded, rear, perspective view of the exemplary oven door of FIG. 3.
Figure 5:
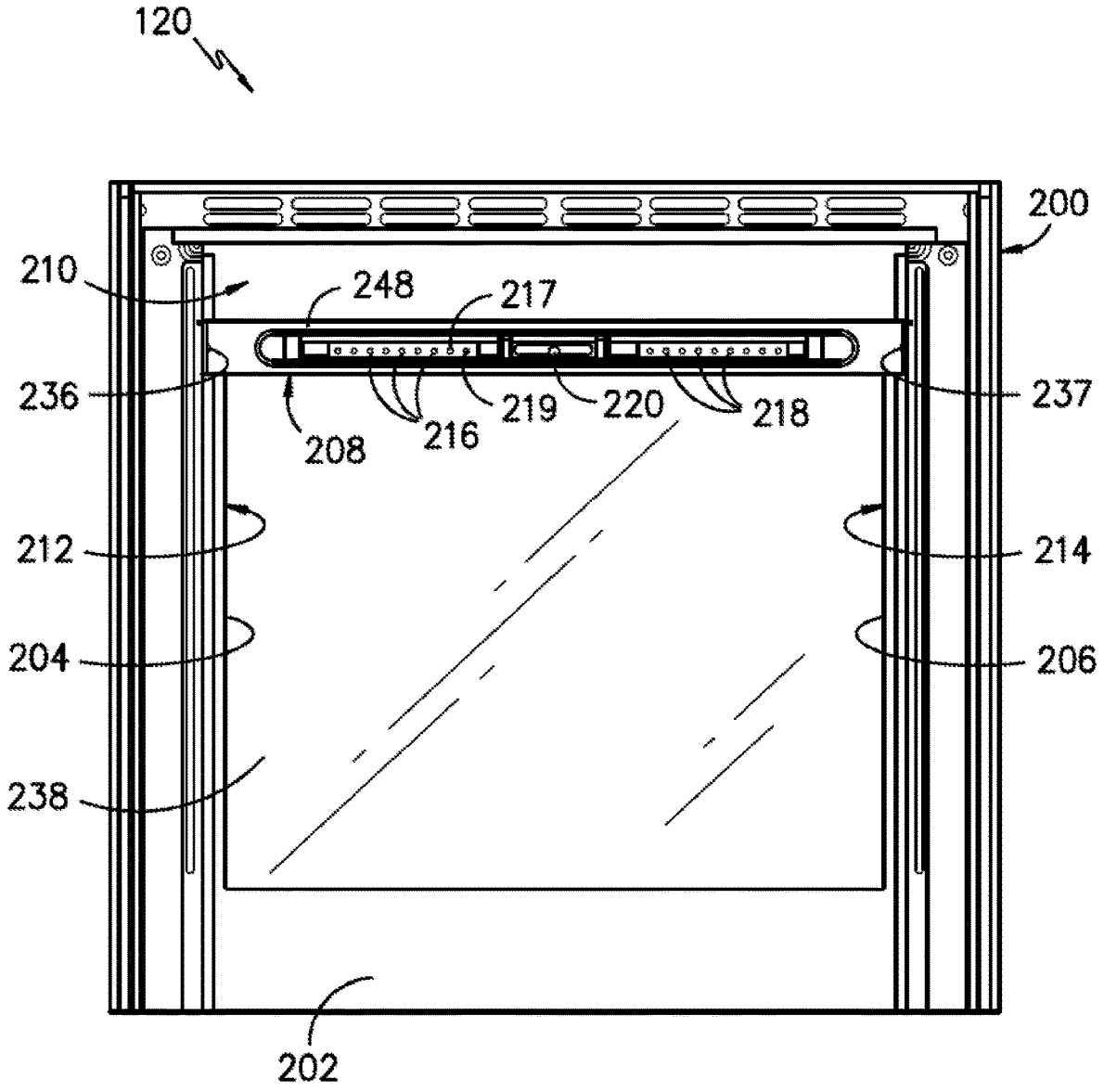
FIG. 5 provides a rear, elevation view of the exemplary oven door of FIG. 3.

Turning especially to FIGS. 3 through 5, FIG. 3 shows door 120 from a perspective rear view, FIG. 4 shows a perspective view of door 120 with a rear panel 202 and a bracket assembly 208 exploded from a front panel 200 of door 120, and FIG. 5 shows an elevation view of door 120 viewed from rear panel 202. Generally, door 120 includes front panel 200 and a pair of trim panels (e.g., first trim panel 204 and second trim panel 206) attached to front panel 200. Door 120 may also include rear panel 202 transversely behind front panel 200 (e.g., disposed rearward from front panel 200 along the transverse direction T). Trim panels 204, 206 are on opposing lateral sides of door 120. As shown in FIG. 3, front panel 200 is transversely in front of trim panels 204, 206 and rear panel 202 is transversely behind trim panels 204, 206. In some embodiments, front panel 200 extends between top lip 192 and bottom lip 194. Furthermore, front surface 196 may be on (e.g., defined by) front panel 200. In turn, rear surface 198 may be on (e.g., defined by) rear panel 202.

As described above, door 120 may include window 124, which may include a front glass panel 238 on front panel 200 and a rear glass panel 240 on rear panel 202. In some embodiments, front glass panel 238 is inlaid in front panel 200 or rear glass panel 240 is inlaid in rear panel 202. Additionally or alternatively, front glass panel 238 or rear glass panel 240 form window 124 in door 120. During use, window 124 allows a user to view internal chamber 116 when door 120 is in the closed position.

A door cavity 210 is defined between trim panels 204, 206. According to the arrangement, first trim panel 204 and second trim panel 206 are laterally spaced apart by door cavity 210 defined therebetween. Front panel 200 or rear panel 202 may further define door cavity 210 (e.g., defining door cavity 210 transversely). As would be understood, door cavity 210 is internal to door 120. First trim panel 204 and second trim panel 206 each include an interior surface 212, 214 (first interior surface 212 on first trim panel 204 and second interior surface 214 on second trim panel 206) directed toward door cavity 210. Additionally or alternatively, door cavity 210 may be defined laterally by interior surfaces 212, 214. In other words, interior surfaces 212, 214 may bound door cavity 210 along the lateral direction L.

As shown, door 120 includes bracket assembly 208. Generally, bracket assembly 208 extends through door cavity 210. In some embodiments, bracket assembly 208 extends between first trim panel 204 and second trim panel 206. In the illustrated embodiment, bracket assembly 208 extends the full length of door cavity 210 in lateral direction L, attaching to trim panels 204, 206. In some embodiments, bracket assembly 208 includes a planar plate (e.g., a main body 248) that extends in the vertical direction V and in the lateral direction L. In certain embodiments, portions of bracket assembly 208 are parallel to front surface 196, rear surface 198, front glass panel 238, or rear glass panel 240.

Generally, bracket assembly 208 supports plurality of lights 216, 218 and camera 220. Bracket assembly 208 includes a back bracket 215. As shown especially in FIG. 3, bracket assembly 208 may extend the full lateral length of door cavity 210, attached to trim panels 204, 206 at each respective interior surface 212, 214. As shown, at least one light source (e.g., plurality of light sources 216, 218) or a camera 220 may be mounted onto bracket assembly 208. In some embodiments, the mounting may be a direct mounting, such as directly mounting to back bracket 215. For example, camera 220 or plurality of light sources 216, 218 may be mounted directly by being attached to bracket assembly 208 with one or more fasteners. In certain embodiments, plurality of light sources 216, 218 or camera 220 are indirectly mounted via a bracket housing 256, bracket housing 256 coupled between light sources 216, 218 and back bracket 215.

Camera 220 may be aligned in a central location (e.g., in a lateral direction L) on bracket assembly 208 (e.g., on back bracket 215 or bracket housing 256). For example, camera 220 may be located about equidistant from interior surfaces 212, 214 on back bracket 215 or on bracket housing 256, bracket housing 256 attached to back bracket 215. As shown, camera 220 is angled at a non-orthogonal angle (e.g., angle CV on FIG. 9) relative to vertical direction V. For this exemplary embodiment, bracket housing 256 extends at an angle to direct a camera lens on camera 220 rearward and slanted somewhat downward. During use, camera 220 is angled to take images of internal chamber 116 and articles placed therein. In some embodiments, camera 220 is located at a central lateral location of door 120, for example, in lateral direction L and vertical direction V.

Generally, camera 220 may be any type of device suitable for capturing at least one image or video. As an example, camera 220 may be a video camera or a digital camera with an electronic image sensor [e.g., a charge coupled device (CCD) or a CMOS sensor]. Although the term "image" is used herein, it should be appreciated that according to exemplary embodiments, camera 220 may take any suitable number or sequence of two-dimensional images, videos, or other visual representations of internal chamber 116 or items (e.g., food) positioned therein. For example, the one or more images may include a video feed or a series of sequential static images obtained by camera 220 that may be transmitted to controller 162 (e.g., as a data signal) for analysis or other manipulation. In some embodiments, camera 220 transmits images or video feed directly to a remote user device (e.g., through wireless signal). During use, camera 220 may take images or video feed in coordination with plurality of light sources 216, 218, such as to obtain higher quality or truer-to-color images of internal chamber 116 or items therein.

As shown, light sources 216, 218 may extend (e.g., are disposed outward) from the central location of camera 220. For instance, light sources 216, 218 may be disposed on opposite lateral sides of camera 220. In some embodiments, plurality of light sources 216, 218 are aligned on either lateral side of camera 220 along bracket assembly 208. In some embodiments, light sources 216, 218 may be positioned vertically above and below camera 220. Camera 220 and the plurality of light sources 216, 218 may face rear panel 202. Additionally or alternatively, plurality of light sources 216, 218 may be angled at a non-orthogonal angle relative to vertical direction V. For example, at least one of the plurality of light sources 216, 218 may be angled at an acute angle relative to vertical direction V. In certain embodiments, light source 216 may be angled at a different angle from light source 218. In some embodiments, light sources 216, 218 each include a plurality of lighting elements (e.g., lighting element 217, 219).

In the illustrated embodiments, light sources 216, 218 are aligned linearly, with each lighting element (e.g., lighting element 217) in light sources 216, 218 aligned next to at least one adjoining lighting element (e.g., lighting element 219) in lateral direction L. In some embodiments, light sources 216, 218 align on either lateral side of camera 220, light source 216 including a plurality of lighting elements aligned in lateral direction L that extend toward trim panel 204, and light source 218 including a plurality of lighting elements aligned in lateral direction L that extend toward trim panel 206. In certain embodiments, and as shown in FIG. 5, light sources 216, 218 extend from camera 220 in a line that extends along more than half of the lateral length of bracket assembly 208. For example, in FIG. 5, light sources 216, 218 are aligned from camera 220 outward in lateral direction L such that light sources 216, 218 end at a position that is laterally closer to trim panels 204, 206, respectively, than to camera 220. In additional or alternative embodiments, plurality of light sources 216, 218 include LED lights, halogen lights, or equivalent light sources. In some embodiments, there may be between five and ten light sources 216, 218 on either side of camera 220. In some embodiments, plurality of light sources 216, 218 may each be a bar style light, each bar extending laterally from camera 220 on bracket assembly 208. Plurality of light sources 216, 218 may be configured to illuminate internal cavity 136 or articles placed therein. Advantageously, plurality of light sources 216, 218 may minimize glare (e.g., by reflecting light off of rear glass panel 240) or color distortions in images produced by camera 220. Furthermore, positioning of light sources 216, 218 may reduce glare in some embodiments.

Figure 6:
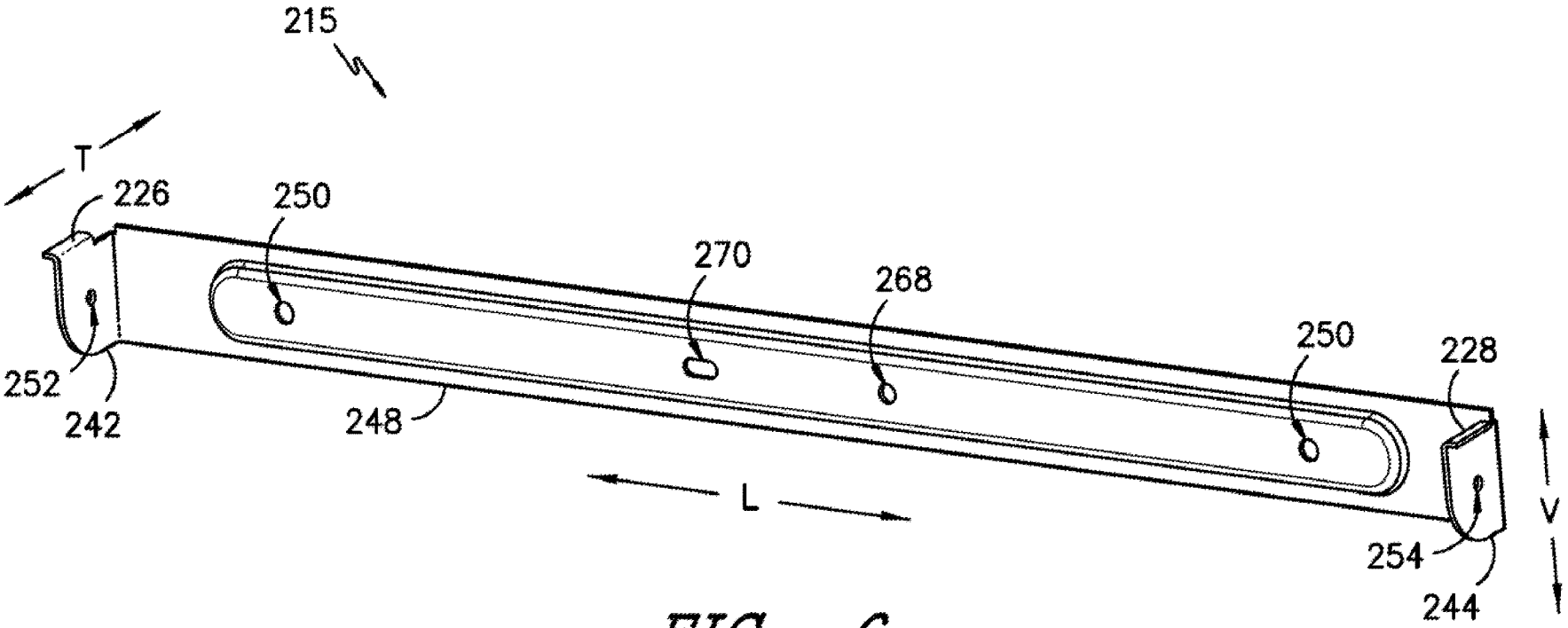
FIG. 6 provides a perspective view of an exemplary back bracket according to exemplary embodiments of the present disclosure.

Turning to FIGS. 5 and 6, back bracket 215 includes main body 248, a first wing 242, and a second wing 244. As shown in FIG. 5, main body 248 extends laterally across oven door 120 between the pair of trim panels (i.e., first trim panel 204 and second trim panel 206). Back bracket 215 attaches to first interior surface 212 at first wing 242 and to second interior surface 214 at second wing 244, first and second wings 242, 244 extending laterally from main body 248 on either end of main body 248. In other words, first and second wings 242, 244 extend along the lateral direction L on either end of main body 248 (e.g., as will be described in detail below). When assembled, camera 220 and plurality of light sources 216, 218 may be supported on (e.g., fixed to) main body 248. In turn, main body 248 also includes sufficient vertical height to support camera 220 and plurality of light sources 216, 218.

In some embodiments, wings 242, 244 extend transversely toward rear panel 202 from main body 248. One or both wings 242, 244 may attach to main body 248. For instance, one wing 242, 244 may attach at each at a lateral end of main body 248. In certain embodiments, wings 242, 244 attach to main body 248 at an angle roughly orthogonal to main body 248. In the illustrated embodiment, wings 242, 244 attach vertically at lateral ends of main body 248 and extend rearward in transverse direction T. Additionally or alternatively, wings 242, 244 may extend parallel to interior surfaces 212, 214. Optionally, each wing 242, 244 may include a respective fastener opening 252, 254. In some embodiments, wings 242, 244 have a transverse length less than or equal to each transverse length of interior surfaces 212, 214 of trim panels 204, 206.

As shown in FIG. 6, bracket assembly 208 may include a first support flange 226. In the illustrated embodiment first support flange 226 is attached to back bracket 215. First support flange 226 extends out from main body 248 in lateral direction L. In some embodiments, first support flange 226 attaches to first wing 242. In the illustrated examples, first support flange 226 is attached to a vertical top of first wing 242. First support flange 226 extends out from first wing 242 in lateral direction L. First support flange 226 may extend orthogonally from first wing 242 in transverse direction T and lateral direction L. In the illustrated embodiments, main body portion 248, first support flange 226, and first wing 242 are all mutually orthogonal to one another.

As further shown in FIG. 6, bracket assembly 208 may include a second support flange 228. Second support flange 228 is attached to back bracket 215. Second support flange 228 extends out from main body 248 in lateral direction L. For instance, support flanges 226, 228 may each be attached to an opposing lateral end of back bracket 215 and may be orthogonal to back bracket 215. In some embodiments, second support flange attaches to second wing 244. In the illustrated examples, second support flange 228 is attached to a vertical top of second wing 244. Second support flange 228 extends out from second wing 244 in lateral direction L. Second support flange 228 may extend orthogonally from second wing 244 in transverse direction T and lateral direction L. According to the arrangement, second support flange 228 is parallel to first support flange 226 and orthogonal to both second wing 244 and to main body portion 248.

In some embodiments, main body 248 includes at least one clip opening 250. As shown, main body 248 includes two clip openings 250. Clip openings 250 aid in attaching bracket housing 256 to back bracket 215. For example, clip openings 250 are shaped to accept clips (e.g., clips 264 on bracket housing 256) therethrough. In certain embodiments, clip openings 250 aid in attaching plurality of light sources 216, 218 directly onto back bracket 215. For example, plurality of light sources 216, 218 may have a clip that clips through openings 250, directly attaching plurality of light sources 216, 218 to back bracket 215.

In the illustrated embodiments, main body 248 includes first tab opening 268 or adjustable tab opening 270. First tab opening 268 aids in attaching bracket housing 256 to back bracket 215. Adjustable tab opening 270 aids in attaching bracket housing 256 to back bracket 215. Additionally or alternatively, adjustable tab opening 270 may also allow position of bracket housing 256 to be adjusted during mounting to back bracket 215. First tab opening 268 or adjustable tab opening 270 may be sized to friction fit (e.g., in vertical direction V) with tabs 266. In certain embodiments, first tab opening 268 or adjustable tab opening 270 aid in attaching camera 220 directly to back bracket 215. In embodiments where camera 220 is directly mounted to back bracket 215, adjustable tab opening 270 may allow camera 220 to be adjusted in position (e.g., in lateral direction L) on back bracket 215.

Figure 7:
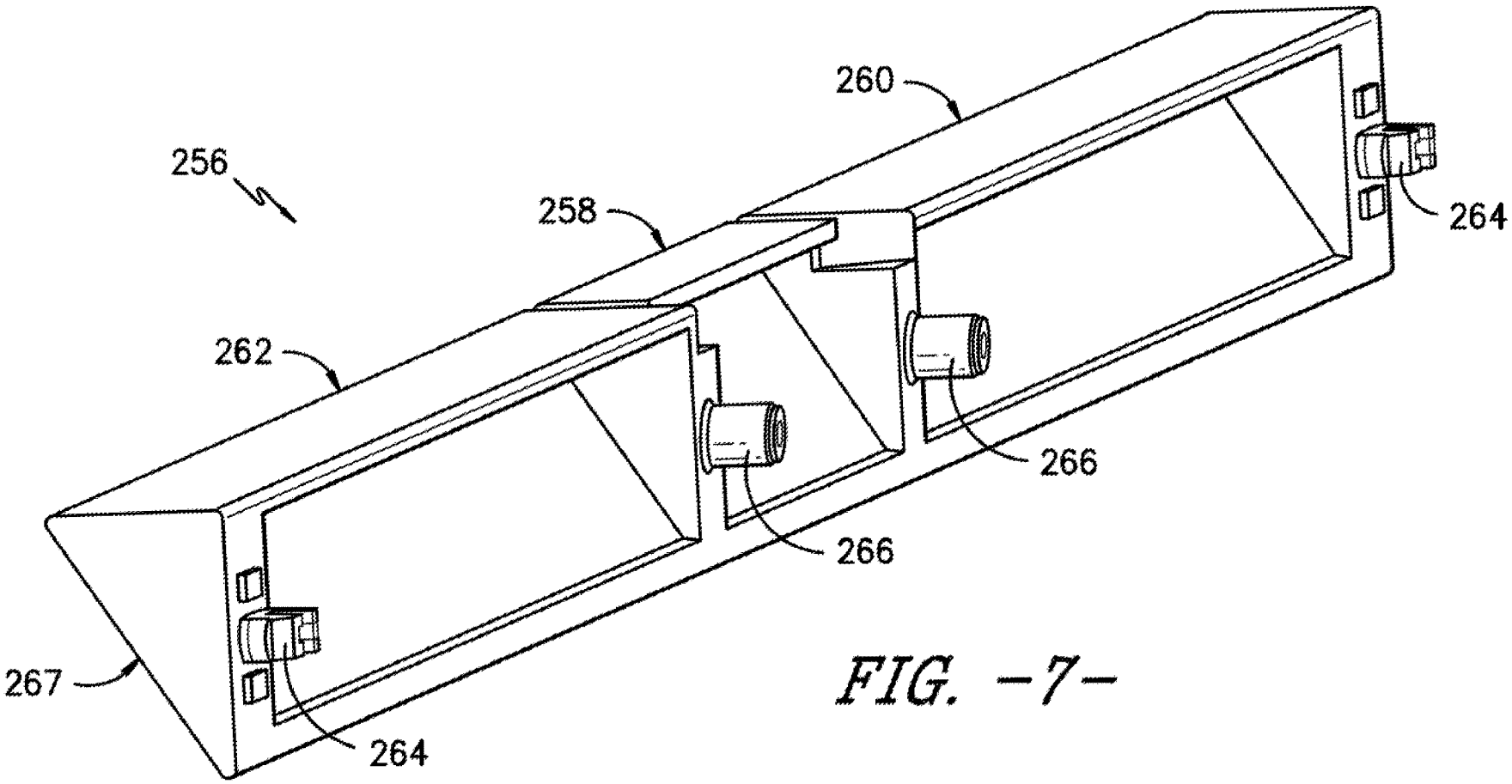
FIG. 7 provides a perspective view of an exemplary bracket housing according to exemplary embodiments of the present disclosure.
Figure 9:
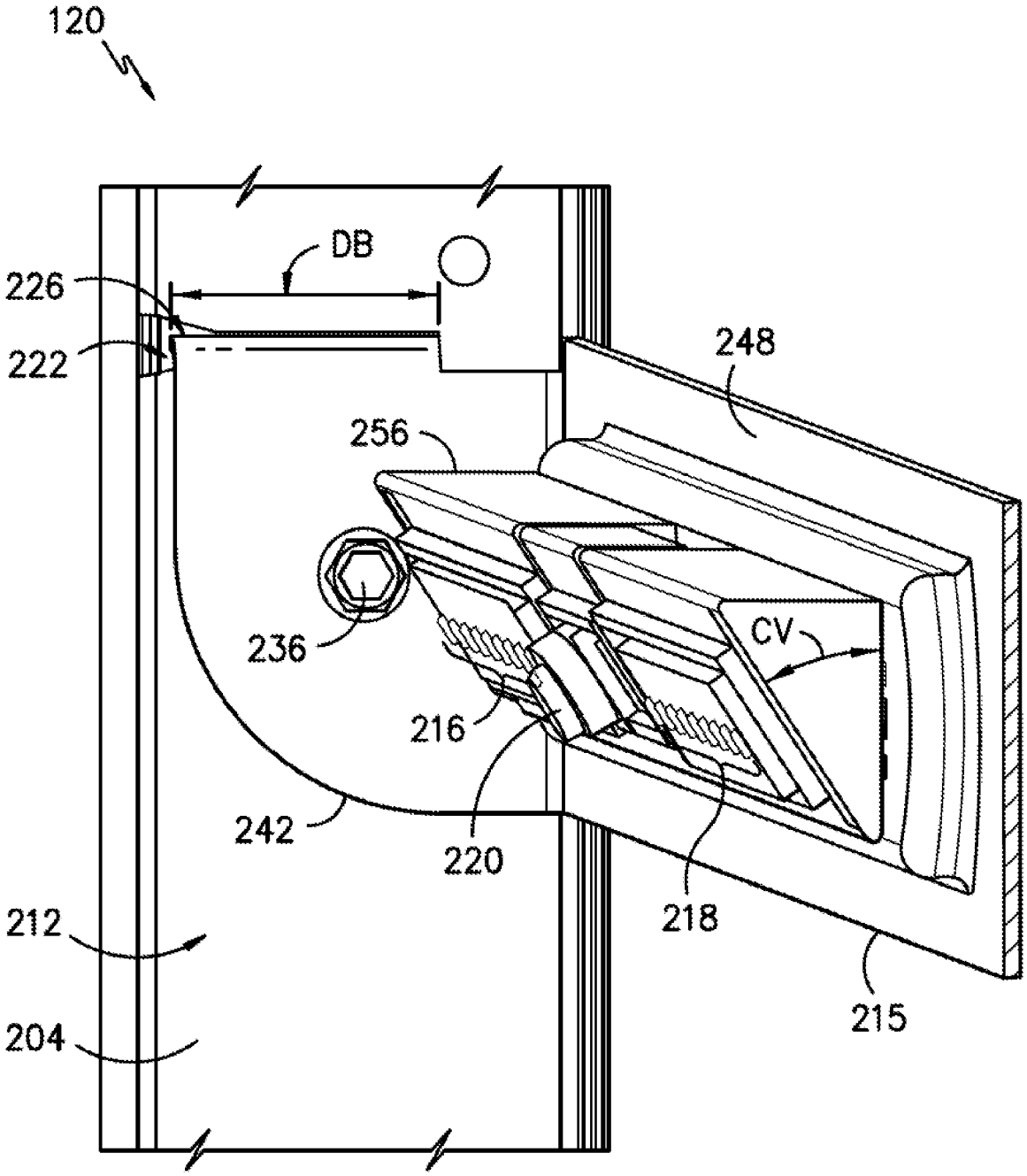
FIG. 9 provides another perspective view of a portion of an exemplary bracket assembly and exemplary door according to exemplary embodiments of the present disclosure.

As shown in FIGS. 7 and 9, bracket housing 256 may extend in lateral direction L. For instance, bracket housing 256 may extend along at least a portion of main body portion 248 in lateral direction L. Moreover, bracket housing 256 may join or attach to main body portion 248 of back bracket 215. In the illustrated embodiment, bracket housing 256 includes one or more projections (e.g., clips 264 or tabs 266) attached to a back side 265 of bracket housing 256. When assembled, one or more projections 264, 266 may attach to one or more of the openings 250, 268, 270 of main body 248. For example, clips 264 may be inserted into openings 250 on back bracket 215, snapping into place. Additionally or alternatively, tabs 266 may be inserted into openings 268 and 270 of back bracket 215 and may be held with a friction fit. In some embodiments, tabs 266 and clips 264 may attach bracket housing 256 to main body portion 248 of back bracket 215. In certain embodiments, one of clips 264 and tabs 266 attach bracket housing 256 to back bracket 215. In some embodiments, bracket housing 256 may be secured to back bracket 215 via one or more fasteners, such as a mechanical fastener (e.g., screws, rivets, nails, or bolts, adhesives, or welds, or solders).

Bracket housing 256 may further include a camera housing position 258, located centrally along bracket housing 256. Camera may install onto bracket housing 256 at camera housing position 258. Bracket housing 256 may also include a first lighting position 260 and a second lighting position 262. First light sources 216 may attach to bracket housing 256 at first lighting position 260. Second light sources 218 may attach to bracket housing 256 at second lighting position 262. Cameral housing position 258, first lighting position 260, and second lighting position 262 may attached at a forward surface 267 of bracket housing. Additionally or alternatively, forward surface 267 may be angled at a non-zero angle (e.g., angle CV in FIG. 9) relative to vertical direction V. During use, forward surface 267 angle CV may allow camera and lighting to be directed toward articles placed within internal chamber 116. Angle of forward surface 267 may be an acute angle. As shown, camera 220 is directed downward in vertical direction V and rearward in transverse direction T by the angle of forward surface 267. In the illustrated embodiments, camera 220 is flush or parallel to forward surface 267.

Additionally or alternatively, forward surface 267 may be angled at a non-zero angle (e.g., angle CV) relative to vertical direction V. During use, forward surface 267 angle CV may allow camera and lighting to be directed toward articles placed within internal chamber 116. As shown in FIG. 9, housing 256 may orient camera 220 for viewing food or other articles placed in internal chamber 116 at angle CV. Advantageously, angle CV may allow camera 220 to generate images of internal chamber 116 such that articles placed within internal chamber 116 are always or nearly always within the image of camera 220. During use, camera 220 may be able to take accurate images of internal chamber 116 with the aid of plurality of lights 216, 218, due to being located at angle CV.

Figure 8:
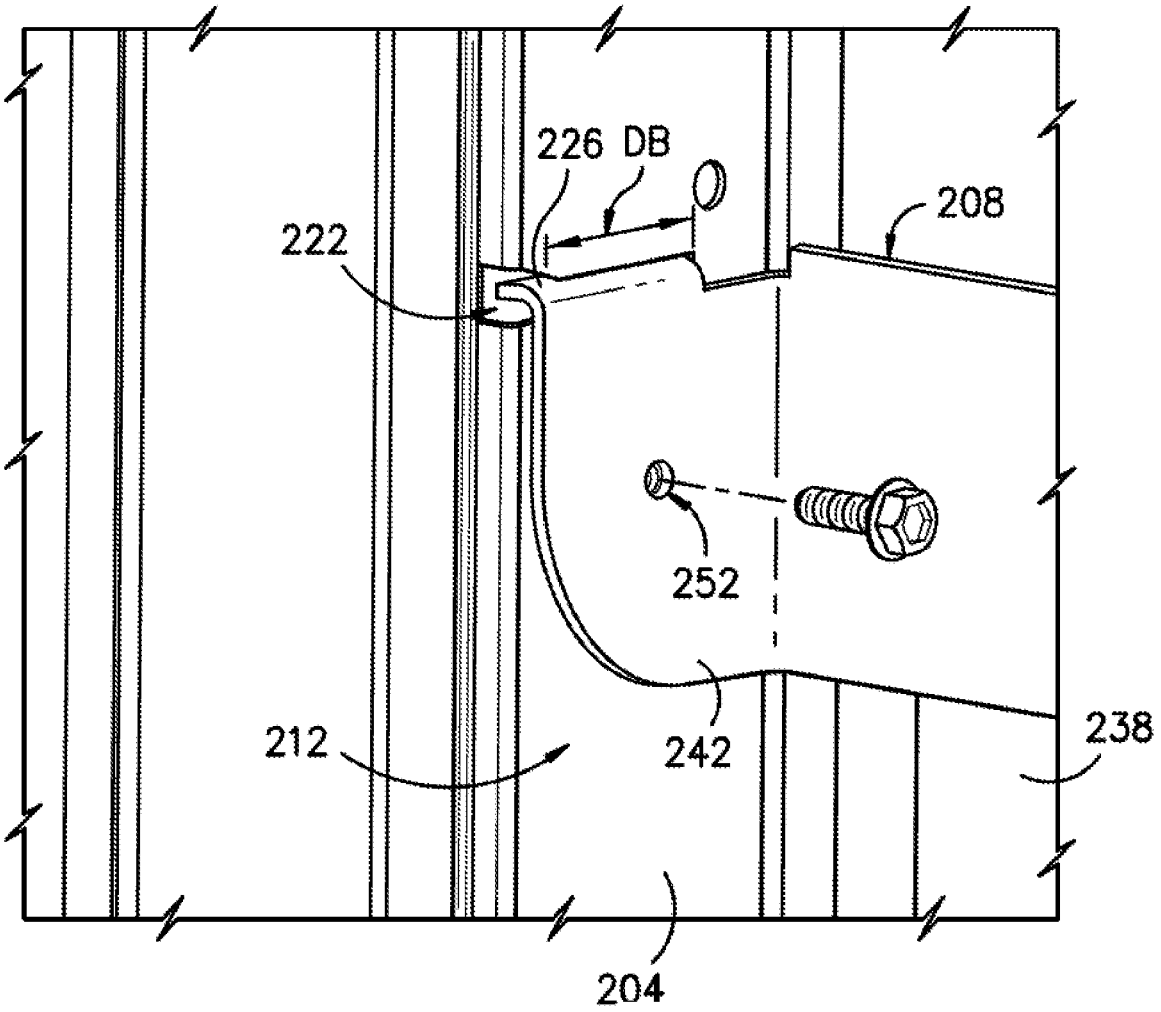
FIG. 8 provides a perspective view of a portion of an exemplary bracket assembly and exemplary door according to exemplary embodiments of the present disclosure.

Turning to FIGS. 8 and 9, first trim panel 204 defines a first bracket slot 222. Second trim panel 206 defines a second bracket slot 224, (e.g., as shown in FIG. 3). Bracket slots 222, 224 may extend transversely along first interior surface 212, and second interior surface 214, respectively. In the illustrated embodiment, bracket slots 222, 224, extend laterally into trim panels 204, 206.

As shown, first support flange 226 is received into first bracket slot 222. In some embodiments, second support flange 228 is received into second bracket slot 224 (e.g., as shown in FIG. 3). During installation, first support flange 226 may be inserted from a rear end of first bracket slot 222 and may be slid across first bracket slot 222 moving forward in transverse direction T into first support flange 226. Depth DB of first bracket slot 222 may vary depending on desired placement of camera 220 and plurality of lights 216, 218. In some embodiments, second bracket slot 224 has the same depth in transverse direction T as that of first bracket slot 222. In some embodiments, second support flange 228 has the same length as first support flange 226 (in lateral direction L). Receiving first support flange 226 into first bracket slot 222 or receiving second support flange 228 into second support slot 224 allows coupling of bracket assembly 208 to first trim panel 204 or to second trim panel 206.

In some embodiments, depth DB of first bracket slot 222 allows for adjustable positions of first support flange 226 and bracket assembly 208. Additionally or alternatively, first support flange 226 may be slidably disposed within first bracket slot 222 to adjust a depth of camera 220 mounted to bracket assembly 208. For example, depth DB of first bracket slot 222 may be longer (e.g., along the transverse direction T) than length of first support flange 226. In turn, first support flange 226 may be permitted to be move along the transverse direction T within first bracket slot 222 (e.g., during assembly) and, thus, adjust the position of bracket assembly 208 relative to first trim panel 204. Second support flange 228 may also be slidably disposed within second bracket slot 224 to adjust depth of camera 220. Furthermore, a depth (e.g., similar to depth DB) of second bracket slot 224 may be longer than length of second support flange 228 allowing for adjustments of second support flange 228 within second bracket slot 224. In certain embodiments, first fastener opening 252 or second fastener opening 254 allows for adjustments of position of bracket assembly 208 within door cavity 210 in transverse direction T.

As shown in FIGS. 8 and 9, bracket assembly 208 further defines first fastener opening 252. In the illustrated embodiments, first fastener opening 252 is located on first wing 242. In some embodiments, first fastener opening 252 extends through first wing 242 in lateral direction L. A fastener 236 (e.g., screw, rivet, bolt, nail, adhesive, etc.) extends through bracket assembly 208 at first fastener opening 252, attaching bracket assembly 208 to first trim panel 204. In some embodiments, fastener 236 extends into an interior of first trim panel 204. In certain embodiments, fastener 236 extends into first trim panel 204 at first interior surface 212. Bracket assembly 208 may be symmetric, with second wing 244 defining a second fastener opening 254 extending through second wing 244 in lateral direction L. A second fastener 237 (e.g., as shown in FIG. 5) extends through bracket assembly 208 at second fastener opening 254, attaching bracket assembly 208 (e.g., second wing 244) to second trim panel 206. Advantageously, wings 242, 244 with fastener openings 252, 254 and fasteners 236, 237 may aid in supporting bracket assembly 208, and may help minimize vibrations of camera 220 during movement of door 120 (e.g., opening or closing door 120).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven door, the oven door having a transverse, a vertical, and a lateral direction, the oven door comprising:

a front panel;

a pair of trim panels attached to the front panel, the pair of trim panels comprising a first trim panel and a second trim panel laterally spaced apart by a door cavity defined therebetween, the first trim panel and the second trim panel each comprising an interior surface directed toward the door cavity, the first trim panel defining a first bracket slot;

a bracket assembly extending through the full length of the door cavity in the lateral direction, between the first trim panel and the second trim panel, the bracket assembly comprising a back bracket and a first support flange received within the first bracket slots wherein the back bracket further comprises a first wing and a main body, the first wing extending transversely from the main body, the main body extending vertically and laterally across the oven door between the pair of trim panels, wherein the first support flange attaches to the first wing, the first support flange extending orthogonally from the first wing in the transverse direction and the lateral direction;

a plurality of light sources mounted to the bracket assembly; and a camera mounted to the bracket assembly.

2. The oven door of claim 1, wherein the second trim panel defines a second bracket slot, and wherein the bracket assembly further comprises a second support flange received within the second bracket slot.

3. The oven door of claim 1, wherein the oven door further comprises a rear panel, and wherein the bracket assembly is disposed between the front panel and the rear panel.

4. The oven door of claim 1, wherein the camera is angled at a non-orthogonal angle relative the vertical direction.

5. The oven door of claim 1, wherein the first support flange is slidably disposed within the first bracket slot to adjust a depth of the camera mounted to the bracket assembly.

6. The oven door of claim 3, wherein the plurality of light sources are aligned on either lateral side of the camera along the bracket assembly, the camera aligned in a central location along the bracket assembly, and wherein the camera and the plurality of light sources face the rear panel.

7. The oven door of claim 1, the bracket assembly further comprising a mechanical fastener extending through the bracket assembly and into the interior surface of the first trim panel.

8. The oven door of claim 1, wherein the front panel further comprises a front glass panel.

9. The oven door of claim 3, wherein the rear panel further comprises a rear glass panel, and wherein the camera faces the rear glass panel.

10. The oven door of claim 1, wherein the first support flange extends laterally out from the main body.

11. The oven door of claim 1, wherein the first wing further defines a first fastener opening extending laterally through the first wing.

12. The oven door of claim 1, the oven door further comprising a rear panel, the second trim panel defining a second bracket slot, and the back bracket further comprising a second wing and a second support flange, the second support flange received within the second bracket slot, the second wing extending transversely toward the rear panel from the main body, wherein the second support flange attaches to the second wing, the second support flange extending orthogonally from the second wing in the transverse and the lateral directions, the second support flange extending laterally out from the main body, and wherein the second wing further defines a second fastener opening extending laterally through the second wing.

13. An oven door, the oven door having a transverse, a vertical, and a lateral direction, the oven door comprising:

a front panel;

a rear panel;

a pair of trim panels attached to the front panel, the pair of trim panels comprising a first trim panel and a second trim panel laterally spaced apart by a door cavity defined therebetween, the first trim panel comprising a first interior surface and the second trim panel comprising a second interior surface, the first interior surface and the second interior surface directed toward the door cavity, the first trim panel defining a first bracket slot;

a bracket assembly extending through the full length of the door cavity in the lateral direction, between the first trim panel and the second trim panel, the bracket assembly comprising a back bracket and first support flange received within the first bracket slot, the back bracket comprising a main body and a first wing, the first wing extending transversely toward the rear panel, the main body extending vertically and laterally across the oven door between the pair of trim panels;

a plurality of light sources mounted to the bracket assembly; and a camera mounted to the bracket assembly, wherein the first support flange attaches to the first wing, the first support flange extending orthogonally from the first wing in the transverse and the lateral directions.

14. The oven door of claim 13, wherein the camera is angled at a non-orthogonal angle relative to the vertical direction.

15. The oven door of claim 13, wherein the first support flange is slidably disposed in the transverse direction within the first bracket slot to adjust a depth of the camera mounted to the bracket assembly.

16. The oven door of claim 13, wherein the bracket assembly is disposed between the front panel and the rear panel.

17. The oven door of claim 16, wherein the plurality of light sources are aligned on either lateral side of the camera along the back bracket, the camera aligned in a central location along the back bracket, and wherein the camera and the plurality of light sources face the rear panel.

18. The oven door of claim 7, wherein the mechanical fastener restricts the bracket assembly from moving in the vertical, lateral, and transverse directions.

19. The oven door of claim 15, wherein the depth of the first bracket slot is longer than a length of the first support flange in the transverse direction.

* * * * *